United States Patent [19]

Fleming et al.

[11] Patent Number: 4,572,277

[45] Date of Patent: Feb. 25, 1986

[54] ARRANGEMENT FOR REMOTE ADJUSTMENT OF THE DIMENSIONS OF A STRAND DURING CONTINUOUS CASTING

[75] Inventors: Günter Fleming, Erkrath; Horst Grothe, Kaarst; Rolf Haselhuhn, Ratingen; Hans-Peter Kaiser, Düsseldorf, all of Fed. Rep. of Germany

[73] Assignee: SMS Concast Inc., Montvale, N.J.

[21] Appl. No.: 705,552

[22] Filed: Feb. 26, 1985

[30] Foreign Application Priority Data

Feb. 29, 1984 [DE] Fed. Rep. of Germany ..... 3407294

[51] Int. Cl.[4] ..... B22D 11/10

[52] U.S. Cl. ..... 164/436; 164/491; 74/665 GA; 74/665 N

[58] Field of Search ..... 164/436, 491; 74/665 GA, 665 N

[56] References Cited

U.S. PATENT DOCUMENTS

| | | | |
|---|---|---|---|
| 3,838,730 | 10/1974 | Nagaoka et al. | 164/436 |
| 3,926,244 | 12/1975 | Meier et al. | 164/491 |
| 4,069,863 | 1/1978 | Hargassner et al. | 164/436 |
| 4,085,793 | 4/1978 | Scheinecker et al. | 164/436 |
| 4,505,321 | 3/1985 | Zeller | 164/491 |
| 4,516,622 | 5/1985 | Thöne et al. | 164/436 |

FOREIGN PATENT DOCUMENTS

| | | | |
|---|---|---|---|
| 94766 | 7/1980 | Japan | 164/491 |
| 2023042 | 6/1978 | United Kingdom | 164/491 |

*Primary Examiner*—Nicholas P. Godici

*Assistant Examiner*—Samuel M. Heinrich

*Attorney, Agent, or Firm*—Peter K. Kontler

[57] ABSTRACT

A vertical continuous casting mold has a pair of wide walls, and a pair of narrow walls which are received between the wide walls. The narrow walls are translatable back-and-forth, and also pivotable, in order to change the width of a strand cast in the mold. Each of the narrow walls is driven by an arrangement which permits the respective narrow wall to be remotely adjusted during casting. The arrangement for each narrow wall includes a pair of internally threaded sleeves which are respectively articulated to an upper and a lower portion of the corresponding wall. A rotatable spindle is threaded into each sleeve. The spindles are operative to cause axial displacement of the associated sleeves in response to rotation of the spindles. The two spindles for each narrow wall are rotated by a common motor. A first transmission transmits motion from the motor to one of the spindles, and a second transmission transmits motion from the motor to the other spindle. The two transmissions are coupled to one another by a coupling device which also connects the transmissions with the motor. The design is such that, in spite of the mechanical connection between the transmissions, one of the spindles is adjustable independently of the other spindle. The mechanical connection between the two transmissions associated with a narrow wall reduces the likelihood of uncontrolled rotation of one spindle by itself. The independent adjustability of one of the spindles for each narrow wall makes it possible to achieve all motions of the respective wall which are necessary to change the width of a strand.

16 Claims, 7 Drawing Figures

ARRANGEMENT FOR REMOTE ADJUSTMENT OF THE DIMENSIONS OF A STRAND DURING CONTINUOUS CASTING

BACKGROUND OF THE INVENTION

The invention relates generally to a continuous casting mold which is adjustable during casting so as to change the dimensions of a continuously cast strand.

More particularly, the invention relates to an arrangement for remotely adjusting a movable wall of a continuous casting mold during casting in order to change the dimensions of a strand being cast.

The West German Auslegeschrift No. 2 340 768 discloses a generally vertical continuous casting mold having a pair of oppositely disposed wide walls, as well as a pair of oppositely disposed narrow walls which are received between the wide walls. The walls cooperate to define a rectangular cavity for casting. The narrow walls are pivotable, and also translatable, for the purpose of effecting a change in the width of the mold cavity, and hence the width of a strand being cast in the mold. This strand has a rectangular cross section.

An arrangement is provided which makes it possible to remotely adjust the narrow walls during a cast, i.e. without interrupting the casting operation. The arrangement includes a pair of spindles for each narrow wall, and one of these spindles is articulated to an upper portion of the respective narrow wall while the other spindle is articulated to a lower portion of the wall. Each of the spindles associated with a narrow wall has a worm drive, and the two worm drives are driven by a common motor via a drive shaft, as well as appropriate gears and couplings. The connection between the motor and the respective spindles is such that the corresponding narrow wall may pivot or translate under the action of the motor.

The connection between a motor and the worm drive of the corresponding lower spindle includes a connecting shaft and an associated clutch. The clutch makes it possible to operate the worm drive for the upper spindle without that for the lower spindle to thereby pivot the respective narrow wall. The operation of the motor and the clutch are regulated in such a manner that the narrow wall can be automatically adjusted during a cast in dependence upon the casting speed, etc.

A drawback of the above arrangement is that air gaps are created between a respective narrow wall and the solidified outer shell of the continuously cast strand when the narrow wall is pivoted. Since this increases the risk of a breakout, i.e. a rupture of the outer shell with an accompanying escape of the molten core confined thereby, the narrow wall must be adjusted at very low speeds in order to minimize air gap formation. This results in an undesirably long transition section which is a conical section of the strand that, during a width change, develops between the rectangular portion of the strand having the original dimensions and the rectangular portion of the strand with the new dimensions. Inasmuch as the transition section is not suitable for further processing, it is preferred to minimize its length.

The known arrangement has another drawback in that it is not possible to pivot a narrow wall on an axis located in the region of the upper portion of the wall.

A further arrangement for adjusting the narrow walls of a mold is disclosed in the European Pat. No. B1-00 28 766. This arrangement has two independent adjusting units for each narrow wall. Each of the adjusting units for a respective narrow wall has its own drive, and the two drives are regulated independently of one another by a computer. In this manner, any desired movement of a narrow wall may be achieved.

The latter arrangement has the drawback that the relative rotational speed of the two drives associated with a narrow wall is controlled purely electronically. Should there be an electronic malfunction, e.g. in the computer, the narrow wall may assume an unacceptable inclination while moving at maximum speed. This, in turn, increases the chance of a breakout.

OBJECTS AND SUMMARY OF THE INVENTION

It is an object of the invention to provide an arrangement which enables the dimensions of a continuously cast strand to be remotely adjusted during casting more reliably than heretofore.

Another object of the invention is to provide an arrangement which enables air gap formation between a movable mold wall and a continuously cast strand to be reduced.

An additional object of the invention is to provide an arrangement which makes it possible to remotely increase or decrease the dimensions of a continuously cast strand during casting.

A further object of the invention is to provide an arrangement which makes it possible to avoid, or at least reduce the magnitude of, uncontrolled movements of a mold wall due to electronic malfunctions.

It is also an object of the invention to provide an arrangement which enables the dimensions of a continuously cast strand to be reliably increased and decreased with relatively little or no uncontrolled movements of a mold wall due to electronic malfunctions, and which makes it possible to reduce air gap formation between the mold wall and the strand while permitting the mold wall to pivot and translate as necessary.

The preceding objects, and others which will become apparent as the description proceeds, are achieved by the invention.

One aspect of the invention resides in an arrangement for remotely adjusting a movable wall of a continuous casting mold during casting to change the dimensions of a continuously cast strand. The arrangement comprises the following:

A. A first displacing unit designed to be articulated to a first portion of the wall. The first unit includes a first displaceable element.

B. A second displacing unit designed to be articulated to a second portion of the wall. The second unit includes a second displaceable element.

C. A motor common to and designed to drive the displaceable elements.

D. A first transmission for transmitting motion from the motor to the first displaceable element.

E. A second transmission for transmitting motion from the motor to the second displaceable element.

F. A coupling device for coupling the transmissions to one another and to the motor. In accordance with the invention, one of the displaceable elements is arranged so as to be adjustable independently of the other element.

The arrangement according to the invention makes it possible to eliminate, or at least reduce, the occurrence of breakouts. Thus, the first and second displaceable elements are mechanically connected with one another so that uncontrolled movements of the mold wall due to unintended displacement of one of the displaceable elements may be avoided or reduced. In spite of the fact that the displaceable elements are mechanically connected, all required movements of the mold wall may be performed in an optimum manner.

The mold may be designed for use in a vertical continuous casting apparatus and, in such an event, the mold and its walls will have a generally vertical orientation during casting. The first displacing unit may then be articulated to an upper portion of the mold wall while the second displacing unit may be articulated to a lower portion of the wall.

The mold may be of the type having a pair of oppositely disposed wide walls, and a pair of oppositely disposed narrow walls which are received between the wide walls and are movable to permit the width of the mold cavity, and hence the width of the strand, to be changed. The displacing units are then articulated to one of the narrow walls. A second arrangement for remote adjustment of a wall may be provided for the other narrow wall.

The first displacing unit may include a first displacing member for moving the first displaceable element, and the second displacing unit may similarly include a second displacing member for moving the second displaceable element. The displaceable elements may be elongated and designed for axial displacement, and the displacing members may be rotatably mounted in such a manner that rotation thereof results in axial displacement of the respective displaceable elements. This may be accomplished, for example, in that each of the displacing members comprises a rotatable spindle which is in threaded engagement with the corresponding displaceable element. A respective worm drive may be used to rotate each displacing member, and each worm drive may be interposed between the associated displacing unit and its transmission.

The independently adjustable element may be arranged so that its axial position is adjustable independently of the other displaceable element. If the displaceable elements are axially movable in response to rotation of the displacing members, the displacing member for the independently adjustable element may be arranged such that its rotational speed is adjustable independently of the other displacing member.

In order to permit independent adjustment of the rotational speed of the displacing member for the independently adjustable element, an additional, speed-regulated motor may be provided to drive this displacing member. The transmission for the independently adjustable element then includes a gear system, preferably a planetary gear system, which is connected with the additional motor. The gear system is designed so that the additional motor is able to effect a change in the rotational speed of the displacing member for the independently adjustable element relative to the rotational speed of the other displacing member. When the displacing members rotate at the same speed, the mold wall translates generally perpendicular to itself. On the other hand, when the displacing members rotate at different speeds, a pivoting action is superimposed on the translational movement of the mold wall.

An alternative manner of arranging for independent adjustment of the rotational speed of the displacing member for the independently adjustable element is to design the associated transmission with a plurality of gear ratios. The coupling device may then include one or more clutch elements for selecting the desired gear ratio. Depending upon the gear ratio, the two displacing members may be driven at the same rotational speed to cause translation of the mold wall generally perpendicular to itself, or at different rotational speeds to effect pivoting of the mold wall as well as translation thereof.

Pivoting of the mold wall may be achieved by means other than independent adjustment of the rotational speed of the displacing member for the independently adjustable element. Thus, a particularly good manner of effecting pivotal movement of the mold wall without independent adjustment of the rotational speed is to provide a second motor which acts on the independently adjustable element or its displacing member. The second motor is arranged to move the independently adjustable element axially relative to the other displaceable element.

Another possibility for effecting pivotal movement of the mold wall is to design the transmission for each displacing unit with a clutch element. Appropriate manipulation of the clutch elements then enables the mold wall to be translated generally perpendicular to itself, or to be pivoted. The second displacing unit is here preferably articulated to the mold wall in the region of the lowermost edge thereof.

The novel features which are considered as characteristic of the invention are set forth in particular in the appended claims. The improved adjusting arrangement itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
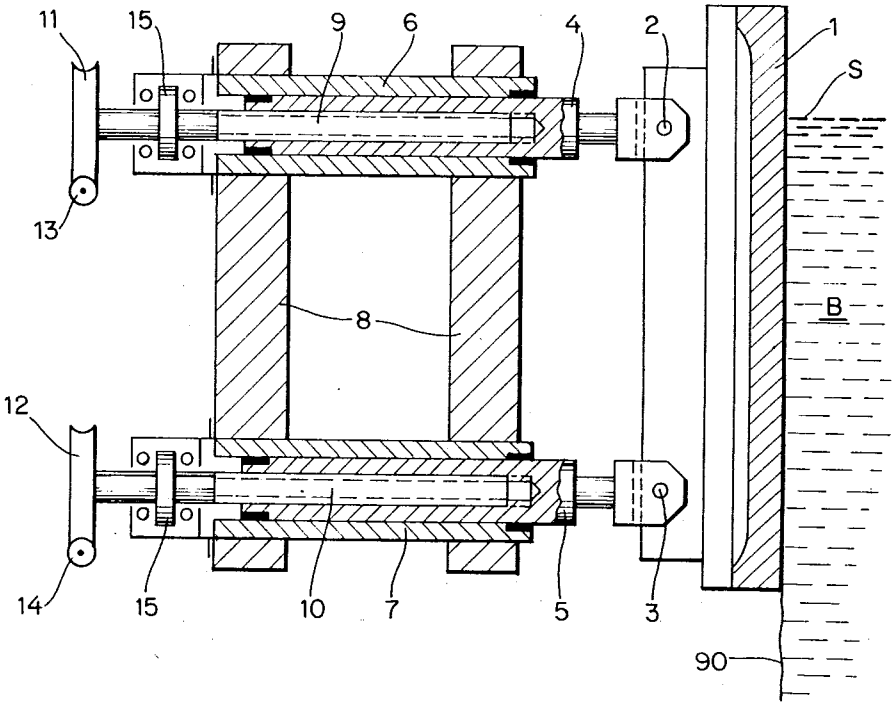
FIG. 1 is a cross-sectional view of a mold wall and an arrangement for remotely adjusting the same.

Referring to FIG. 1, the reference numeral 1 identifies a wall of a continuous casting mold, e.g. a mold for the continuous casting of steel. The mold is designed for use in a continuous casting apparatus of the vertical type so that the mold and its walls have a generally vertical orientation during casting. This is shown in FIG. 1 where the reference character B denotes a molten bath which is present in the mold while casting proceeds. Molten material is continuously teemed into the mold from above, and a strand 90 is continuously withdrawn from the lower end of the mold in a downward direction. The rate of admission of molten material into the mold, and the rate of withdrawal of the strand 90 from the mold, are controlled in such a manner that the level of the surface S of the bath B remains approximately constant. The strand 90 consists of a thin, solidified outer shell and a molten core upon issuing from the mold.

The mold of FIG. 1 is a plate mold having a pair of oppositely disposed wide walls, and a pair of oppositely disposed narrow walls, including the wall 1, which are received between the wide walls. Of these walls, only the narrow wall 1 is shown in FIG. 1. The wide walls and narrow walls cooperate to define a rectangular mold cavity which accommodates the bath B. Due to the rectangular shape of the mold cavity, the strand 90 has a rectangular cross section. The narrow walls are pivotable, as well as translatable back-and-forth, for the purpose of increasing or decreasing the width of the mold cavity, and hence the width of the strand 90.

Each of the narrow walls is provided with an arrangement which permits the respective narrow wall to be pivoted and translated from a remote location. These arrangements are designed in such a manner that the narrow walls may be adjusted without interrupting the casting operation, that is, without interrupting the admission of molten material into the mold and the withdrawal of the strand 90 from the mold. This enables the dimensions of the strand 90 to be efficiently changed as desired.

An adjusting arrangement is described herein for the illustrated narrow wall 1. It will be understood that an identical adjusting arrangement may be provided for the other narrow wall.

With reference still to FIG. 1, the side of the narrow wall 1 remote from the bath B is provided with an upper pivot 2 and a lower pivot 3. The upper pivot 2 is connected with one end of an elongated, internally threaded sleeve 4 while the lower pivot 3 is connected with one end of an elongated, internally threaded sleeve 5. The internally threaded sleeve 4 is slidably guided in a bushing 6 mounted on a support 8 whereas the internally threaded sleeve 5 is slidably guided in a bushing 7 likewise mounted on the support 8.

A spindle 9 is threaded into the internally threaded sleeve 4 and, similarly, a spindle 10 is threaded into the internally threaded sleeve 5. Each of the spindles 9,10 has a free end which projects from the respective sleeve 4,5. A worm wheel 11 is secured to the free end of the spindle 9 while a worm wheel 12 is secured to the free end of the spindle 10. The worm wheel 11 is caused to rotate by a worm 13, and the worm wheel 12 is caused to rotate by a second worm 14.

Each of the spindles 9,10 is provided with a thrust bearing 15.

The internally threaded sleeve 4 and the spindle 9 together define a first or upper displacing unit for moving the narrow wall 1. The sleeve 4 constitutes a first displaceable element whereas the spindle 9 constitutes a first displacing member for shifting the sleeve 4.

The internally threaded sleeve 5 and the spindle 10 together define a second or lower displacing unit for moving the narrow wall 1. The sleeve 5 constitutes a second displaceable element, and the spindle 10 constitutes a second displacing member for shifting the sleeve 5.

The first and second displacing units are designed in such a manner that, as the respective spindles 9,10 are rotated by the corresponding worm drives 11,13 and 12,14, the sleeves 4,5 are shifted axially.

Figure 2:
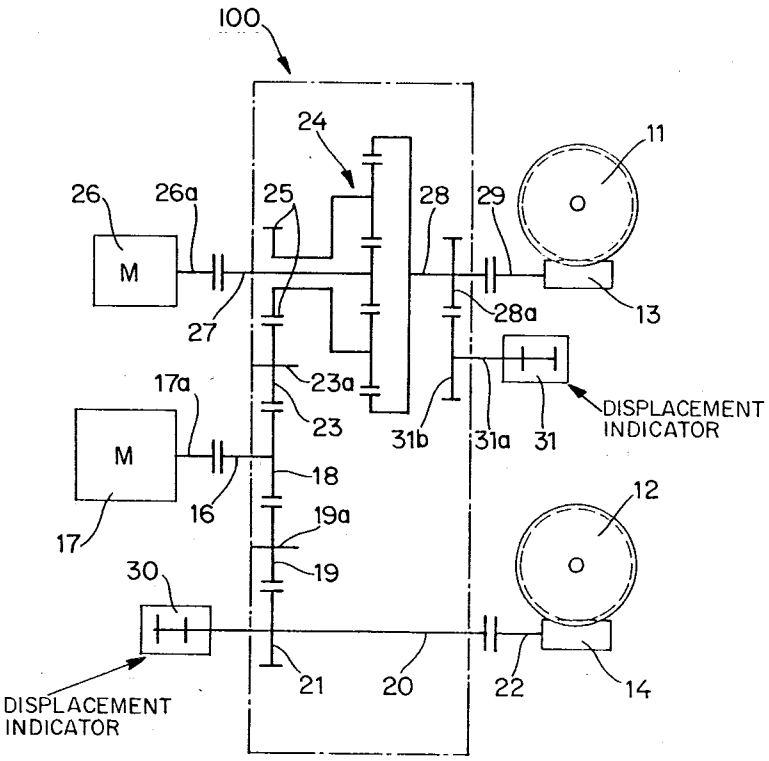
FIG. 2 schematically illustrates certain details of the adjusting arrangement of FIG. 1.

FIG. 2 shows a drive mechanism for driving the displacing units 4,9 and 5,10. The drive mechanism includes a primary motor 17 which is common to and arranged to drive both of the displacing units 4,9 and 5,10. The motor 17 has an output shaft **17*a* which is coupled to an input shaft 16 of a transmission unit 100. The end of the input shaft 16 remote from the motor 17 carries an input gear 18. The input gear 18 meshes with an intermediate gear 19 which is fast with a shaft 19*a*, and the intermediate gear 19, in turn, meshes with a further gear 21. The gear 21 is secured to a lower output shaft 20 of the transmission unit 100, and the output shaft 20 is coupled to a worm shaft 22 which drives the worm 14**.

The input gear 18 also meshes with a second intermediate gear 23 which is fast with a shaft **23*a*, and the intermediate gear 23, in turn, meshes with another gear 25. The gear 25 engages a planetary gear system 24 which drives an upper output shaft 28 of the transmission unit 100. The output shaft 28 is coupled to a further worm shaft 29 which rotates the worm 13**.

The gear 25 is mounted on a pinion shaft 27 for rotation relative to the latter. One end of the pinion shaft 27 is secured to the planetary gear system 24 while the other end of the pinion shaft 27 is coupled to the output shaft **26*a* of an additional or auxiliary motor 26. The auxiliary motor 26** is a speed-regulated motor designed to operate at relatively low rotational speeds.

The gears 23–25 together define a first transmission for transmitting motion from the primary motor 17 to the first displacing unit 4,9. Similarly, the gears 19,21 together define a second transmission for transmitting motion from the primary motor 17 to the second displacing unit 5,10. The components 16,18 together define a coupling device which couples the transmissions 23–25 and 19,21 to one another and to the primary motor 17.

When the spindles 9,10 rotate at the same speed, the mold wall 1 translates generally perpendicular to itself, i.e. from left to right or vice versa in FIG. 1. On the other hand, when the spindles 9,10 rotate at different speeds, the mold wall 1 is caused to undergo a pivoting motion in addition to its translational movement. The superimposition of a pivoting motion on the translational movement of the mold wall 1 is made possible by the auxiliary motor 26 and the planetary gear system 24 which enable the rotational speed of the spindle 9 to be changed relative to that of the spindle 10.

The position of the mold wall 1 is shown by displacement indicators 30 and 31. The displacement indicator 30 is directly connected with the output shaft 20 of the transmission unit 100. The displacement indicator 31, on the other hand, has a shaft **31*a* which carries a gear 31*b*. The gear 31*b* meshes with another gear 28*a* which, in turn, is fast with the output shaft 28 of the transmission unit 100**.

Figure 3:
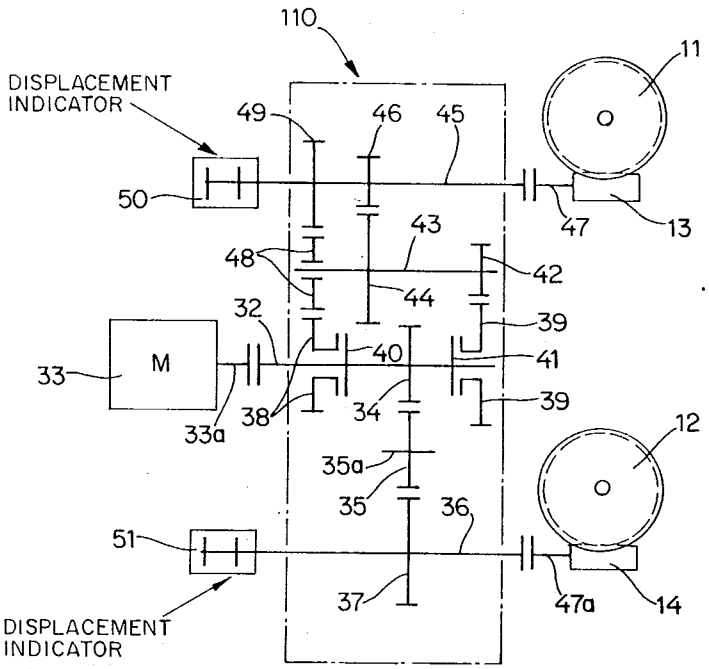
FIG. 3 schematically illustrates certain details of another embodiment of an adjusting arrangement for the mold wall of FIG. 1.

FIG. 3 shows another embodiment of a drive mechanism for driving the displacing units 4,9 and 5,10 of FIG. 1.

The drive mechanism of FIG. 3 again includes a primary motor 33 which is common to and arranged to drive both of the displacing units 4,9 and 5,10. The motor 33 has an output shaft **33*a* which is coupled to an input shaft 32 of a transmission unit 110. The input shaft 32 carries an input gear 34. The input gear 34 meshes with an intermediate gear 35 which is fast with a shaft 35*a*, and the intermediate gear 35, in turn, meshes with a further gear 37. The gear 37 is secured to a lower output shaft 36 of the transmission unit 110, and the output shaft 36 is coupled to a worm shaft 47***a* which drives the worm 14.

A pair of additional gears 38 and 39 is mounted on the input shaft 32 for rotation relative to the latter. The gear 38 may be made to rotate with the input shaft 32 through the agency of a clutch element 40 which is connected with the input shaft 32 and is movable to and from a position of driving engagement with the gear 38. Similarly, the gear 39 may be caused to rotate with the input shaft 32 by means of a second clutch element 41 which is fast with the input shaft 32 and is movable to and from a position of driving engagement with the gear 39. The clutch element 41 is disengaged from the gear 39 when the clutch element 40 is in engagement with the gear 38 while, on the other hand, the clutch element 40 is disengaged from the gear 38 when the clutch element 41 engages the gear 39.

The gear 39 is in mesh with an intermediate gear 42 which is secured to an intermediate shaft 43. A second intermediate gear 44 is mounted for rotation with the intermediate shaft 43 and meshes with a further gear 46. The gear 46 is connected with an upper output shaft 45 of the transmission unit 110, and the output shaft 45 is coupled to a worm shaft 47 which drives the worm 13.

The gear 38 meshes with an intermediate gear 48 which is mounted on the intermediate shaft 43 for rotation relative to the latter. The intermediate gear 48, in turn, meshes with another gear 49 which is again fast with the upper output shaft 45 of the transmission unit 110.

The gears 42,44,46,48,49 together define a first transmission for transmitting motion from the primary motor 33 to the first displacing unit 4,9. Likewise, the gears 35,37 together define a second transmission for transmitting motion from the motor 33 to the second displacing unit 5,10. The components 32, 34 and 38–41 together define a coupling device for coupling the first and second transmissions 42,44,46,48,49 and 35,37 to one another and to the primary motor 33.

The gears 42,44,46 of the first transmission have a different gear ratio than the gears 48,49 of the first transmission. One of these gear ratios may be the same as that of the gears 35,37 constituting the second transmission. When those gears of the first transmission having the same gear ratio as the second transmission are in driving engagement with the input shaft 32 of the transmission unit 110, the mold wall 1 will translate generally perpendicular to itself. On the other hand, when those gears of the first transmission having a different gear ratio than the second transmission are in driving engagement with the input shaft 32 of the transmission unit 110, a pivoting motion will be superimposed upon the translational movement of the mold wall 1.

The position of the mold wall 1 is shown by displacement indicators 50 and 51. The displacement indicator 50 is directly connected with the upper output shaft 45 of the transmission unit 110 while the displacement indicator 51 is directly connected with the lower output shaft 36 of the transmission unit 110.

In the embodiments of FIGS. 1–3, the rotational speed of the spindle 9 is adjustable independently of the spindle 10. Since the internally threaded sleeves 4,5 move axially in response to rotation of the respective spindles 9,10, it follows that the axial position of the sleeve 4 is adjustable independently of the sleeve 5.

Figure 4:
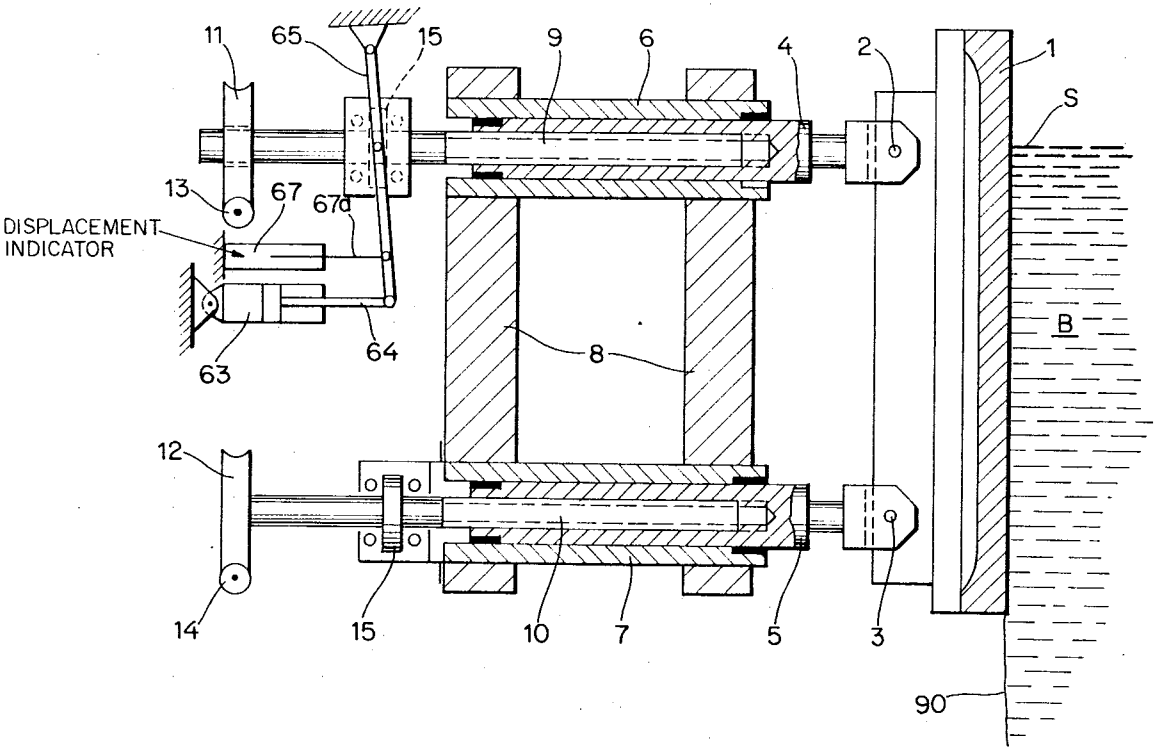
FIG. 4 is similar to FIG. 1 but illustrates a further embodiment of an adjusting arrangement.

FIG. 4 is a view similar to FIG. 1 but illustrates a somewhat different embodiment. Those components of FIG. 4 which are analogous to components of FIG. 1 are identified by the same reference characters. The embodiment of FIG. 4 differs from that of FIG. 1 mainly in that the spindle 9 is movable axially. To this end, the worm wheel 11 in FIG. 4 is not fixed to the spindle 9 but is designed so that the spindle 9 can translate relative thereto.

Figure 5:
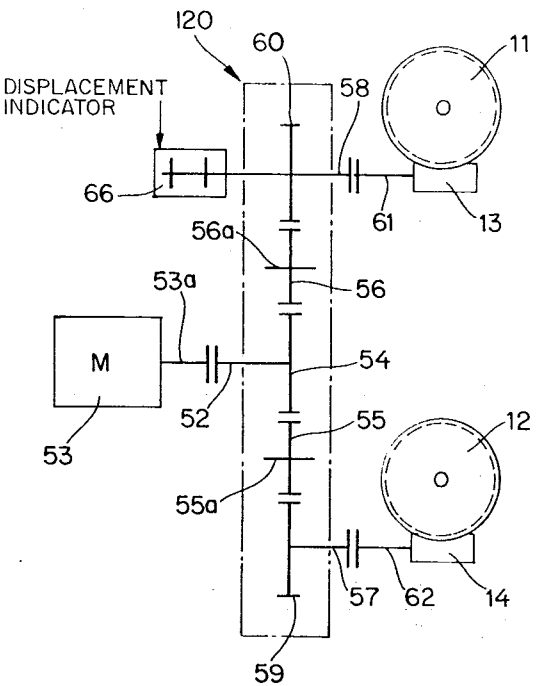
FIG. 5 schematically illustrates certain details of the adjusting arrangement of FIG. 4.

FIG. 5 shows a drive mechanism for driving the displacing units 4,9 and 5,10 of FIG. 4. The drive mechanism includes a primary motor 53 which is common to and arranged to drive both of the displacing units 4,9 and 5,10. The motor 53 has an output shaft 53*a* which is coupled to an input shaft 52 of a transmission unit 120. The end of the input shaft 52 remote from the motor 53 is fixed to an input gear 54. The input gear 54 is in mesh with an intermediate gear 55 which is fast with a shaft 55*a*, and the intermediate gear 55, in turn, meshes with a further gear 59. The gear 59 is secured to a lower output shaft 57 of the transmission unit 120, and the output shaft 57 is coupled to a worm shaft 62 which drives the worm 14.

The input gear 54 also meshes with a second intermediate gear 56 which is fast with a shaft 56*a*, and the intermediate gear 56, in turn, is in mesh with another gear 60. The gear 60 is mounted for rotation with an upper output shaft 58 which is coupled to a worm shaft 61. The worm shaft 61 rotates the worm 13.

The drive mechanism of FIG. 5 is designed in such a manner that operation of the primary motor 53 causes the spindles 9 and 10 to rotate at the same speed. Accordingly, the primary motor 53 effects displacement of the mold wall 1 generally perpendicular to itself.

Referring back to FIG. 4, it has already been mentioned that the spindle 9 is movable in axial direction thereof. The purpose is to achieve pivotal movement of the mold wall 1.

Axial displacement of the spindle 9 is obtained through the agency of a fluid-operated motor 63 which is here in the form of a piston-and-cylinder unit. The flow of fluid into and out of the piston-and-cylinder unit 63 is regulated as necessary to achieve the desired pivotal movement of the mold wall 1. The piston-and-cylinder unit 63 comprises a piston rod 64 having a free end which projects from the cylinder of the unit 63. The free end of the piston rod 64 is pivotally connected with one end of a lever 65 which, in turn, is pivotally connected with the thrust bearing 15 of the spindle 9 in the region of its other end. Axial displacement of the spindle 9 by the piston-and-cylinder unit 63 results in axial displacement of the sleeve 4. Thus, the piston-and-cylinder unit 63 enables the sleeve 4 to be shifted axially relative to and independently of the sleeve 5 thereby causing pivotal movement of the mold wall 1.

The position of the mold wall 1 is shown by displacement indicators 66 and 67. The displacement indicator 66 is directly connected with the upper output shaft 58 of the transmission unit 120. On the other hand, the displacement indicator 67 is provided with a shaft 67*a* which is secured to the lever 65 connecting the piston-and-cylinder unit 63 with the spindle 9.

In the embodiment of FIG. 5, the gears 56,60 together define a first transmission for transmitting motion from the primary motor 53 to the first displacing unit 4,9. Similarly, the gears 55,59 together define a second transmission for transmitting motion from the primary motor 53 to the second displacing unit 5,10. The components 52,54 together define a coupling device for coupling the first and second transmissions 56,60 and 55,59 to one another and to the primary motor 53.

FIG. 6 again is a view similar to FIG. 1 but illustrates yet another embodiment. Those components of FIG. 6 which are analogous to components of FIG. 1 are identified by the same reference characters. The embodiment of FIG. 6 differs from that of FIG. 1 in that the lower displacing unit 5,10 is articulated to the mold wall 1 adjacent to, rather than above, the lowermost edge of the latter.

Figure 6:
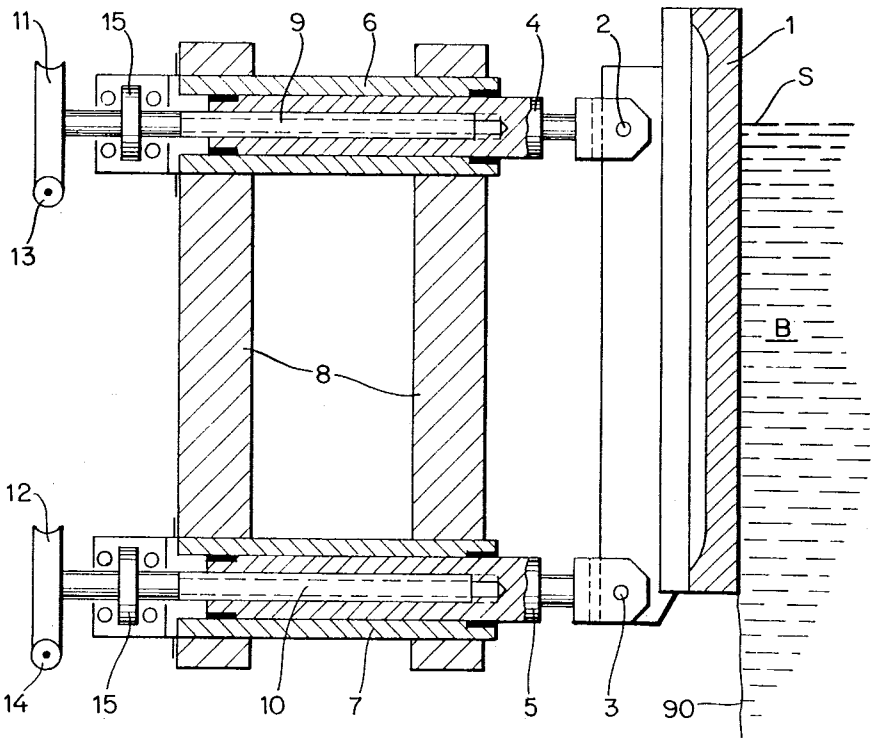
FIG. 6 is similar to FIG. 1 but illustrates an additional embodiment of an adjusting arrangement.
Figure 7:
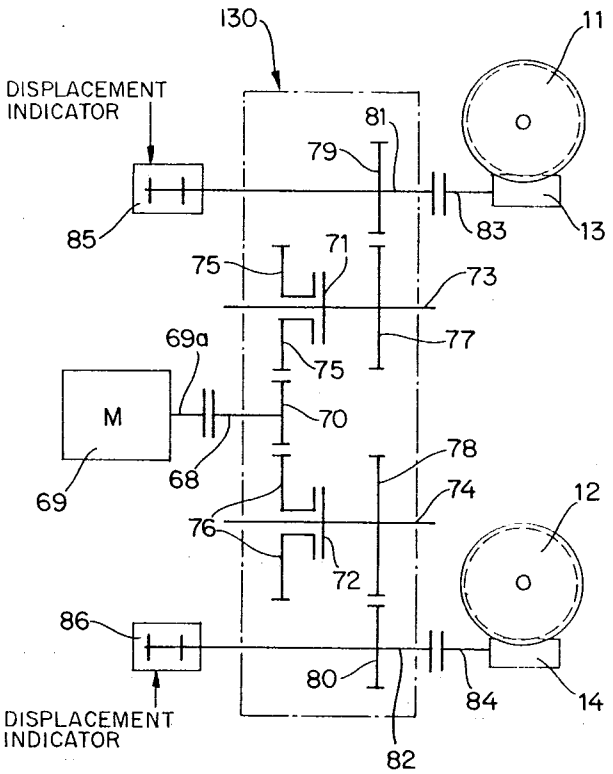
FIG. 7 schematically illustrates certain details of the adjusting arrangement of FIG. 6.

FIG. 7 shows a drive mechanism for driving the displacing units 4,9 and 5,10 of FIG. 6. The drive mechanism includes a primary motor 69 which is common to and arranged to drive both of the displacing units 4,9 and 5,10. The motor 69 has an output shaft 69*a* which is coupled to an input shaft 68 of a transmission unit 130. The end of the input shaft 68 remote from the motor 69 carries an input gear 70. The input gear 70 is in mesh with an intermediate gear 76 which is mounted on an intermediate shaft 74 for rotation relative to the latter. A clutch element 72 is fast with the intermediate shaft 74 and is movable to and from a position of driving engagement with the intermediate gear 76. The intermediate shaft 74 further carries a second intermediate gear 78, and the second intermediate gear 78 meshes with another gear 80. The gear 80 is secured to a lower output shaft 82 of the transmission unit 130, and the output shaft 82 is coupled to a worm shaft 84 which drives the worm 14.

The input gear 70 is also in mesh with an additional intermediate gear 75 which is mounted on an additional intermediate shaft 73 for rotation relative to the latter. A clutch element 71 is fast with the intermediate shaft 73 and is movable to and from a position of driving engagement with the intermediate gear 75. The intermediate shaft 73 additionally carries yet another intermediate gear 77, and this intermediate gear 77 meshes with a further gear 79. The gear 79 is secured to an upper output shaft 81 of the transmission unit 130, and the output shaft 81 is coupled to a worm shaft 83 which rotates the worm 13.

The gears 75,77,79 together define a first transmission for transmitting motion from the primary motor 69 to the first displacing unit 4,9. Likewise, the gears 76,78,80 together define a second transmission for transmitting motion from the primary motor 69 to the second displacing unit 5,10. The components 68,70 together define a coupling device for coupling the first and second transmissions 75,77,79 and 76,78,80 to one another and to the primary motor 69.

By controlled engagement of the clutch elements 71,72 with, and controlled disengagement of the latter from, the respective intermediate gears 75,76, the mold wall 1 may be caused to translate generally perpendicular to itself or to pivot about a selected one of the upper and lower pivots 2,3.

The position of the mold wall 1 is shown by displacement indicators 85 and 86. The displacement indicator 85 is directly connected with the upper output shaft 81 of the transmission unit 130 while the displacement indicator 86 is directly connected with the lower output shaft 82 thereof.

Referring once more to FIG. 6, it was mentioned earlier that the lower displacing unit 5,10 is articulated to the mold wall 1 adjacent to the lowermost edge of the latter, i.e. the lower pivot 3 is situated adjacent to the lowermost edge of the mold wall 1. This makes it possible to reduce stressing of the outer shell of the continuously cast strand 90 by the lowermost edge of the mold wall 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An arrangement for remotely adjusting a movable wall of a continuous casting mold during casting to change the dimensions of a continuously cast strand, said arrangement comprising:
   (a) a first displacing unit designed to be articulated to a first portion of the wall, said first unit including a first displaceable element;
   (b) a second displacing unit designed to be articulated to a second portion of the wall, said second unit including a second displaceable element;
   (c) a motor common to and designed to drive said elements;
   (d) a first transmission for transmitting motion from said motor to said first element;
   (e) a second transmission for transmitting motion from said motor to said second element; and
   (f) a coupling device for coupling said transmissions to one another and to said motor, one of said elements being arranged so as to be adjustable independently of the other of said elements.

2. The arrangement of claim 1, wherein the mold has a pair of oppositely disposed wide walls, and a pair of oppositely disposed narrow walls which are relatively movable to change the width of the continuously cast strand, said units being designed to be articulated to one of the narrow walls.

3. The arrangement of claim 1, wherein the wall has a generally vertical orientation during casting, and said first unit is designed to be articulated to an upper portion of the wall while said second unit is designed to be articulated to a lower portion of the wall.

4. The arrangement of claim 1, said elements being elongated and mounted for axial displacement; and wherein the axial position of said one element is adjustable independently of said other element.

5. The arrangement of claim 1, said first unit including a first displacing member for moving said first element, and said second unit including a second displacing member for moving said second element; and wherein said members are rotatable, and the rotational speed of the member for said one element is adjustable independently of the rotational speed of the member for said other element.

6. The arrangement of claim 1, said first unit including a first displacing member for moving said first element, and said second unit including a second displacing member for moving said second element; and wherein said members are rotatable, and each of said elements is mounted so as to be axially displaceable in response to rotation of the corresponding member.

7. The arrangement of claim 6, wherein each of said members comprises a spindle in threaded engagement with the respective element.

8. The arrangement of claim 1, comprising a worm drive between each of said elements and the respective transmission.

9. The arrangement of claim 1, comprising an additional motor which is coupled to the transmission for said one element.

10. The arrangement of claim 9, wherein said additional motor is speed regulated.

11. The arrangement of claim 9, wherein the transmission for said one element comprises a planetary gear system, and said additional motor is connected with said system.

12. The arrangement of claim 1, wherein the transmission for said one element has a plurality of gear ratios.

13. The arrangement of claim 12, wherein said coupling device comprises at least one clutch element for gear ratio selection.

14. The arrangement of claim 1, said one element being elongated and mounted for axial displacement; and further comprising another motor which is arranged to drive said one element in axial direction thereof.

15. The arrangement of claim 1, wherein each of said transmissions comprises a clutch element.

16. The arrangement of claim 15, wherein the wall has a generally vertical orientation during casting, and said first unit is designed to be articulated to an upper portion of the wall while said second unit is designed to be articulated to the wall in the region of the lowermost edge thereof.

* * * * *